United States Patent [19]

Nysted

[11] 4,330,086

[45] May 18, 1982

[54] NOZZLE AND METHOD FOR GENERATING FOAM

[75] Inventor: Leonard N. Nysted, Highland Park, Ill.

[73] Assignee: Duraclean International, Deerfield, Ill.

[21] Appl. No.: 145,344

[22] Filed: Apr. 30, 1980

[51] Int. Cl.[3] ..... B05B 7/04; A62C 5/06

[52] U.S. Cl. ..... 239/8; 169/5; 239/428.5; 239/432

[58] Field of Search ..... 169/14, 15; 239/8, 335, 239/343, 370, 428.5, 429, 432, 590, 590.5

[56] References Cited

U.S. PATENT DOCUMENTS

| | | | |
|---|---|---|---|
| 2,127,883 | 8/1938 | Norton . | |
| 2,183,561 | 12/1939 | Hamblin | 261/76 |
| 2,423,618 | 7/1947 | Ratzer | 261/116 |
| 2,513,417 | 7/1950 | Lindsay | 261/116 |
| 2,559,592 | 7/1951 | Button et al. | 239/590 |
| 2,597,913 | 5/1952 | Webster | 261/116 |
| 2,603,469 | 7/1952 | Bedford et al. | 261/116 |
| 2,630,183 | 3/1953 | Foutz | 169/15 |
| 2,683,627 | 7/1954 | Wahlin . | |
| 2,722,458 | 11/1955 | Wahlin . | |
| 2,743,138 | 4/1956 | Wahlin . | |
| 2,761,516 | 9/1956 | Vassilkovsky | 169/15 |
| 2,765,856 | 10/1956 | Schultz | 169/15 |
| 2,766,026 | 10/1957 | Boyd | 261/76 |
| 2,774,583 | 12/1956 | Haftke | 261/76 |
| 2,990,165 | 6/1961 | Joseph | 261/25 |
| 3,084,874 | 4/1963 | Jones et al. | 239/424 |
| 3,139,934 | 7/1964 | Gorski | 169/31 |
| 3,199,790 | 8/1965 | Giesemann | 239/428 |
| 3,202,360 | 8/1965 | O'Brien | 239/119 |
| 3,316,579 | 5/1967 | Smith | 15/320 |
| 3,361,412 | 1/1968 | Cole . | |
| 3,496,881 | 2/1970 | Bylsma | 417/189 |
| 3,521,824 | 7/1970 | Wilcox | 239/424.5 |
| 3,561,536 | 2/1971 | Henshaw | 169/15 |
| 3,563,461 | 2/1971 | Cole, Jr. et al. | 239/8 X |
| 3,604,509 | 9/1971 | Sachnik | 169/15 |
| 3,693,886 | 9/1972 | Conrad | 239/432 |
| 3,701,482 | 10/1972 | Sachnik | 239/590.3 |
| 3,747,851 | 7/1973 | Conrad | 239/8 |
| 3,770,209 | 11/1973 | Wilcox | 239/434 |
| 3,784,111 | 1/1974 | Piggott | 239/432 X |
| 3,793,690 | 2/1974 | Wayne | 239/590 X |
| 3,836,076 | 9/1974 | Conrad et al. | 239/8 |

FOREIGN PATENT DOCUMENTS

| | | | |
|---|---|---|---|
| 221878 | 6/1959 | Australia . | |
| 568669 | 1/1959 | Canada . | |
| 884912 | 6/1953 | Fed. Rep. of Germany . | |
| 635423 | 3/1962 | Italy | 239/428.5 |
| 627285 | 8/1949 | United Kingdom . | |
| 976867 | 12/1964 | United Kingdom . | |
| 1178631 | 1/1970 | United Kingdom . | |
| 1412348 | 11/1975 | United Kingdom . | |

*Primary Examiner*—Andres Kashnikow

*Attorney, Agent, or Firm*—Hume, Clement, Brinks, Willian & Olds, Ltd.

[57] ABSTRACT

A nozzle and method for generating foam is disclosed which includes a nozzle body, a nozzle inlet, an orifice, a gas inlet, an impingement pin and a nozzle outlet. The nozzle body has upstream and downstream ends and an inner wall defining a passage within the nozzle body. The nozzle inlet at the upstream end of the nozzle body permits introduction of a liquid foam producing agent into the passage. The foam producing agent then passes through the orifice, thereby forming a stream. This stream is directed past the gas inlets in the nozzle body to aspirate gas into the passage. The stream then impinges against the impingement pin which is disposed transversely across the passage. At least the upstream half of the cross-section of the impingement pin is annular so that the impingement pin disrupts the flow of the stream and splits it into secondary streams. These secondary streams pass outwardly on each side of the impingement pin and diverge with respect to each other prior to being deflected inwardly off the inner wall of the nozzle body. The nozzle outlet comprises a transverse slot disposed parallel to the impingement pin so that a thorough mixing between the gas and foam producing agent is effected prior to discharge through the nozzle outlet as foam.

12 Claims, 10 Drawing Figures

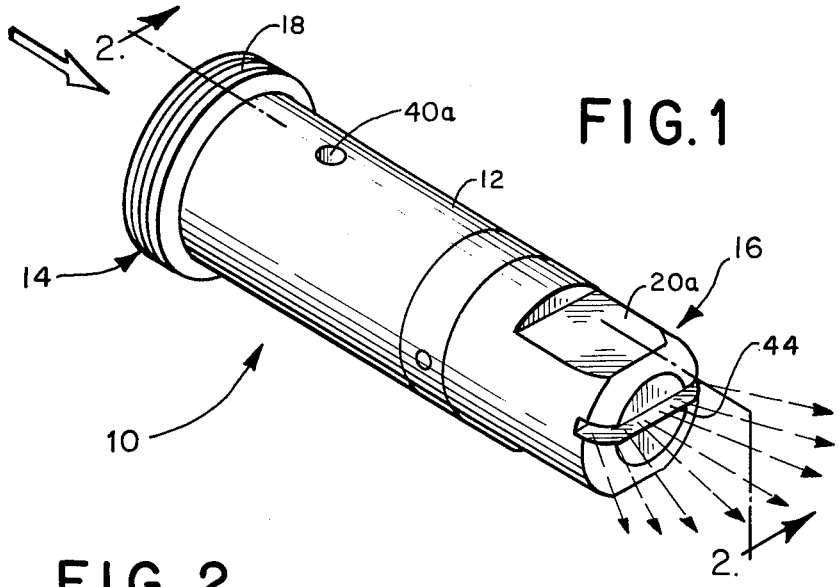
FIG. 1
FIG. 2
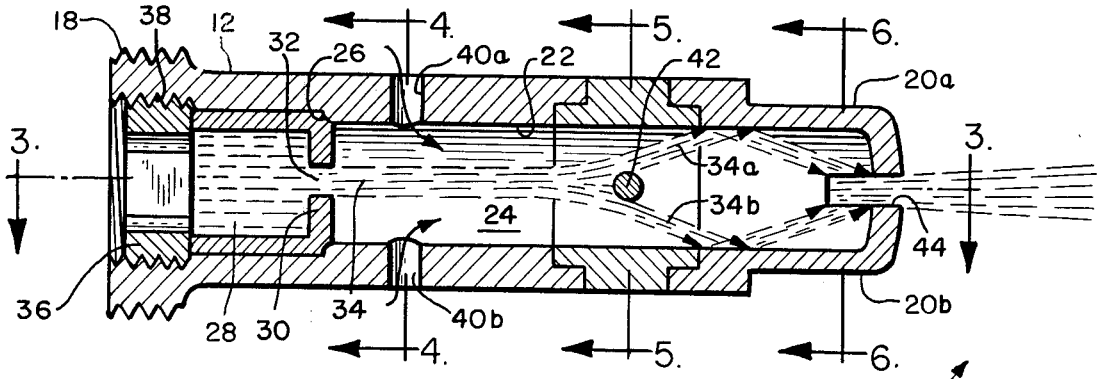
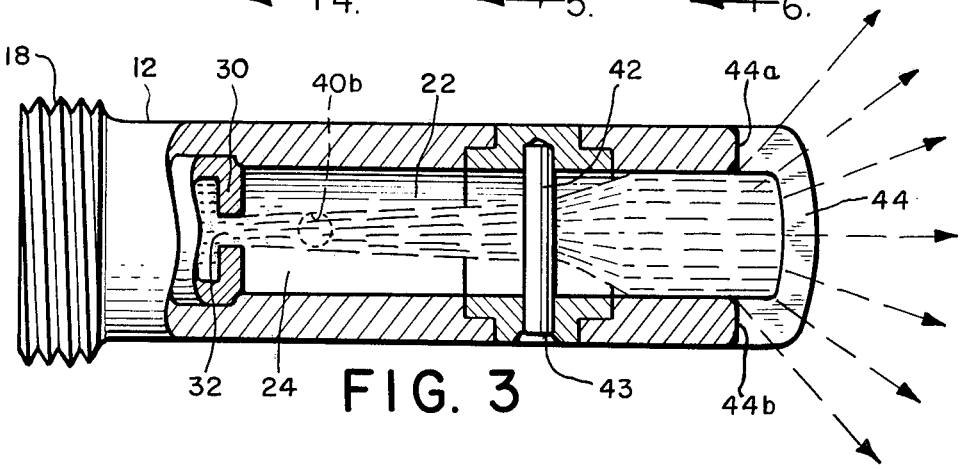
FIG. 3
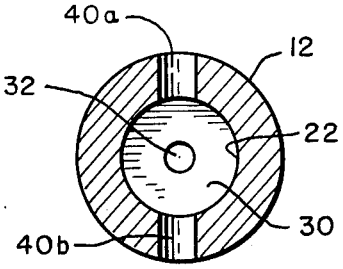
FIG. 4
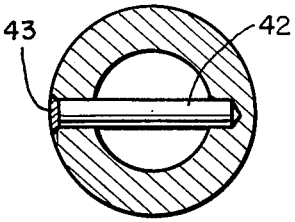
FIG. 5
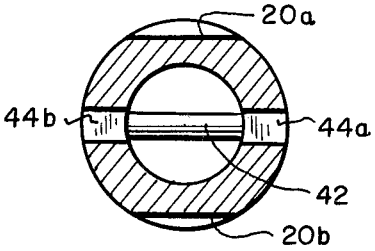
FIG. 6

NOZZLE AND METHOD FOR GENERATING FOAM

BACKGROUND AND SUMMARY OF THE INVENTION

The present invention is directed to new and useful improvements in nozzles of the type used to mix gas with a fluid stream for the purpose of generating a stream of foam. More particularly, the invention is directed to a nozzle having an impingement pin therein adapted to facilitate a thorough mixing of gas with a liquid foam producing agent.

Foams are typically produced by the mixing under proper conditions of a chemical, water and a gas. The particular chemicals used depends upon the use to which the foam will be put, which uses can be widely varied. In the agricultural field, foams are often used as pesticides, and are usually preferable to liquids used for this purpose because of ameliorated wind dispersion problems, and reduced run-off and evaporation once on the vegetation. Because foam is readily visible, it also provides a convenient method of visually determining spray coverage. Foams are also widely used for cleaning operations, whether for articles of living areas. One particularly popular use is in connection with floor coverings such as carpets and rugs. A third important use for foam is in connection with fire fighting equipment. Such equipment may be fixed and automatic, or mobile and manually-operated. For each of these uses it is of great importance that the foam be of substantially uniform consistency and that it be distributed evenly wherever it is applied.

In general, two basic methods have been utilized to generate such foams. One method is through the use of a chemical foaming agent which is added to the solution to be sprayed. The other method is by the introduction of gas such as air into the liquid to form minute bubbles, thereby forming the foam. This latter method is the one to which the present invention relates.

The introduction of air bubbles into a liquid is often done through the use of air aspirating nozzles. In such nozzles, a liquid foam producing agent is introduced into one end of the nozzle and, through the use of one or more orifices, is formed into one or more high velocity streams. Each of these streams is directed past air inlet apertures in the sides of the nozzle, thereby causing air to be aspirated into the nozzle by the resulting reduction in pressure within the nozzle. The flow of the stream is then disrupted to facilitate the mixing of the air and the foam producing agent. This is often done through the use of one or more mesh screens. One such nozzle is disclosed in U.S. Pat. No. 3,784,111. Another means for disrupting the stream flow is through the use of impingement surfaces. For example, U.S. Pat. No. 3,836,076 discloses a nozzle with an inclined annular surface formed on the inner periphery of the nozzle body. This surface is designed to deflect the stream inward to mix the foam producing agent with the gas which is present within the nozzle. A second embodiment of this patent uses a circular impingement disc to disrupt the flow and thereby generate foam.

Each of the above-described nozzles includes a slotted outlet designed to produce a flat, fan-shaped spray of foam. However, despite these attempts to fully mix the foam producing agent with air, these prior designs have been unable to perform in a superior fashion for the applications discussed above. Moreover, the means for disrupting the stream flow in conventional nozzles is not adequately complemented with the slotted outlet to provide a wide, uniform, flat spray of foam.

A German Pat. No. 884,912 to Arentoft discloses the use of a vibrating plate positioned within the axial path of the fluid which is passing through the valve wherein the vibration in the plate is induced by impingement of the fluid on the plate. This design is similarly inadequate in generating foam because, among other reasons, Arentoff has not even attempted to complement the impingement means with a slotted outlet.

The present invention responds to the problems presented in the prior art by providing a superior nozzle and method for generating foam which includes a nozzle body, a nozzle inlet, orifice means, gas inlet means, pin means and a nozzle outlet. The nozzle body has upstream and downstream ends and an inner wall defining a passage within the nozzle body. The nozzle inlet at the upstream end of the nozzle body permits introduction of a liquid foam producing agent into the passage. The foam producing agent then passes through the orifice means, thereby forming a stream. This stream is directed past the gas inlet means in the nozzle body, thus reducing the pressure in the passage and causing gas at atmospheric pressure to be aspirated into the passage. The stream is then impinged against the pin means disposed transversely across the passage. At least the upstream half of the cross-section of the pin means is annular so that the pin means disrupts the flow of the stream and splits it into secondary streams. These secondary streams are directed outwardly, passing to each side of the pin means and diverging with respect to each other prior to being deflected inwardly off the inner wall of the nozzle body. The nozzle outlet comprises a transverse slot disposed parallel to the pin means so that a thorough mixing between the gas and foam producing agent is effected prior to discharge through the nozzle outlet as foam.

These and other objects, features and advantages of the present invention will be apparent from the following description, appended claims and annexed drawings.

BRIEF DESCRIPTION OF THE DRAWING

FIG. 1 is a perspective view of a first embodiment of the invention;

FIG. 2 is a side elevation sectional view taken along line 2—2 of FIG. 1;

FIG. 3 is a plan sectional view taken along line 3—3 of FIG. 2;

FIG. 4 is an end elevation sectional view taken along line 4—4 of FIG. 2;

FIG. 5 is an end elevation sectional view taken along line 5—5 of FIG. 2;

FIG. 6 is an end elevation sectional view taken along line 6—6 of FIG. 2;

DETAILED DESCRIPTION OF THE PREFERRED EMBODIMENTS

Figure 7:
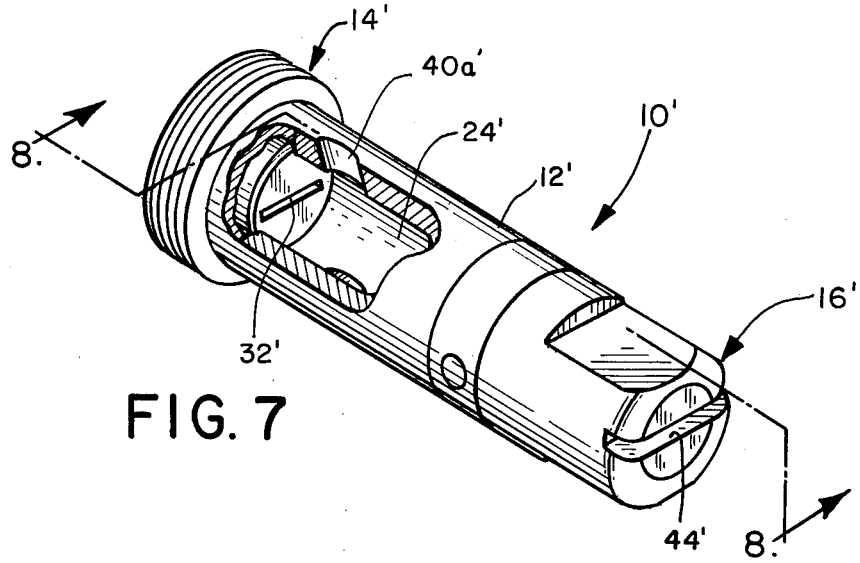
FIG. 7 is a partially-sectioned perspective view of a second embodiment of the invention.

The principles of this invention are particularly useful when embodied in the preferred foam generating nozzle illustrated in FIGS. 1–6, generally indicated by the numeral 10. The nozzle includes a body 12 having upstream and downstream ends 14 and 16, respectively. The upstream and downstream ends, of course, reflect the direction of flow of the foam producing agent through the nozzle 10. The term "foam producing agent" as used herein is intended to define a liquid which is comprised of a chemical designed to generate foam, and a carrier, normally water. However, under certain conditions water itself may be sufficient to produce a light aereated spray upon passing through the nozzle 10. Such a spray should be considered to be within the definition of "foam" as used herein.

The upstream or inlet end 14 of the depicted nozzle 10 includes an external thread 18. This thread 18 provides means to secure the nozzle 10 to a mount (not shown) from which foam producing agent is supplied under pressure into the nozzle 10. The downstream end 16 of the nozzle 10 preferably includes flattened portions 20*a* and 20*b* to permit the nozzle 10 to be screwed into place. Other conventional means may alternately be provided to secure the nozzle 10 in place.

The nozzle body 12 includes inner walls 22 which define a passage 24 through the center of the nozzle 10. In the embodiment of FIGS. 1–6 the inner walls 22 are circular in cross-section, as best shown in FIGS. 4–6. The inner walls 22 are undercut at 26 to provide a seat for a cup-shaped member 28 having a plate 30 at one end. This plate 30 includes an orifice 32. The orifice 32 in the embodiment of FIGS. 1–6 is circular, so it generates a stream 34 of foam producing agent which is circular in cross-section when foam producing agent is introduced, under pressure, into the nozzle 10. The orifice 32 is preferably positioned in the center of the plate 30 so that the axis of the orifice 32 passes through the center of the passage 24.

It may be desirable in certain applications to include a second orifice plate (not shown), thus providing a second axially aligned, orifice with an expansion chamber defined therebetween. This second orifice, which would be positioned upstream of the first, depicted orifice 32, would normally be larger than the first orifice in order to maintain adequate downstream pressure.

The cup-shaped member 28 is retained in position in the nozzle 10 by a locking nut 36 which is threaded into the nozzle body 12 by internal threads 38. The inner periphery of the locking nut 36 is preferably hexagonal in shape to facilitate insertion and removal through the use of a conventional internal wrench.

Downstream of the orifice 32, gas inlet means are provided in the nozzle body 12. The gas inlet means depicted in FIGS. 1–4 comprise two apertures 40*a* and 40*b* through the nozzle body 12, radially spaced 180 degrees apart. The apertures 40*a* and 40*b* thus permit gas (normally air) to be aspirated into the passage 24 when the velocity of the stream 34 of foam producing agent in the passage 24 drops the pressure in the passage 24 below the ambient pressure surrounding the nozzle 10.

Downstream of the apertures 40*a* and 40*b* is an impingement pin 42 disposed transversely across the passage 24 in the path of the stream 34 of foam producing agent. The impingement pin 42 is normally circular in cross-section, as shown best in FIGS. 2 and 8, and preferably is from 0.025 to 0.029 inches in diameter when the diameter of the passage is 0.4 inches. It may alternatively be semi-circular in cross-section (not shown) with the circular half facing upstream. The impingement pin 42 is installed in the nozzle body 12 by drilling a hole through one wall of the nozzle body 12 and into but not through the opposing wall. The impingement pin 42 can then be slid into position and soldered in place at its exposed end as shown at 43.

As mentioned above, the inner walls 22 are circular in cross-section in this embodiment and are substantially uniform in configuration between the impingement pin 42 and the nozzle discharge slot 44. This nozzle discharge slot 44 is positioned in the downstream end 16 of the nozzle 10 and is disposed parallel to the impingement pin 42, thus designed to produce a flat, fan shaped spray of foam from the nozzle 10. The depth of the slot 44 is preferably greater than the thickness of the nozzle body 12 as depicted in FIG. 3 so that the slot 44 includes lateral openings 44*a* and 44*b*. The slot 44 is positioned with respect to the impingement pin 42 such that the secondary streams 34*a* and 34*b* of foam producing agent converge in the vicinity of the discharge slot 44.

The operation of the embodiment depicted in FIGS. 1–6 will now be described. Liquid foam producing agent is introduced under pressure into the upstream end 14 of the nozzle 10. The nozzle 10 will be operable with feed pressures between 10 and 60 p.s.i.g., but the feed pressure is preferably between 35 and 40 p.s.i.g. Upon passing through the orifice 32 the liquid foam producing agent is focused into a stream 34. This stream 34 passes down the center of the passage 24, thus resulting in aspiration of air through the apertures 40*a* and 40*b* in the nozzle body 12.

After the stream 32 passes the apertures 40*a* and 40*b* it impinges upon the impingement pin 42. The impingement pin 42 disrupts the flow of the stream 34 and separates it into secondary streams 34*a* and 34*b*. These secondary streams 34*a* and 34*b* deflect outwardly to both sides of the impingement pin 42, and expand in width as they diverge from each other, as shown in FIG. 3. At this time the streams 34*a* and 34*b* of foam producing agent begin to mix with the air which has been aspirated into the nozzle passage 24 through the apertures 40*a* and 40*b* in the nozzle body 12.

The secondary streams 34*a* and 34*b* are subsequently deflected inwardly off the inner walls 22 toward the discharge slot 44. During this secondary impingement the foam producing agent continues to mix with the air in the nozzle passage 24.

The secondary streams 34*a* and 34*b* converge in the vicinity of the discharge slot 44 at which point the final mixing between the foam producing agent and the air takes place. A uniform spray of foam is thus discharged out of the discharge slot 44 in a wide, flat spray configuration, with minimal dribbling.

The embodiment of FIGS. 7–10 is similar to that described above in some respects and different in others. Corresponding parts from this second embodiment have been labeled with the same numerals except that they have been primed. So, for example, the nozzle itself is indicated by the numeral 10'.

The design of the cup-shaped member 28' is basically the same as that described above except that it includes a narrow slit 32' instead of the circular orifice 32 of the first embodiment. Therefore, the stream 34' passing from the slit 32' is generally in the form of a plane of foam producing agent. The configuration of this stream 34' can be seen best in FIGS. 8 and 9.

Figure 8:
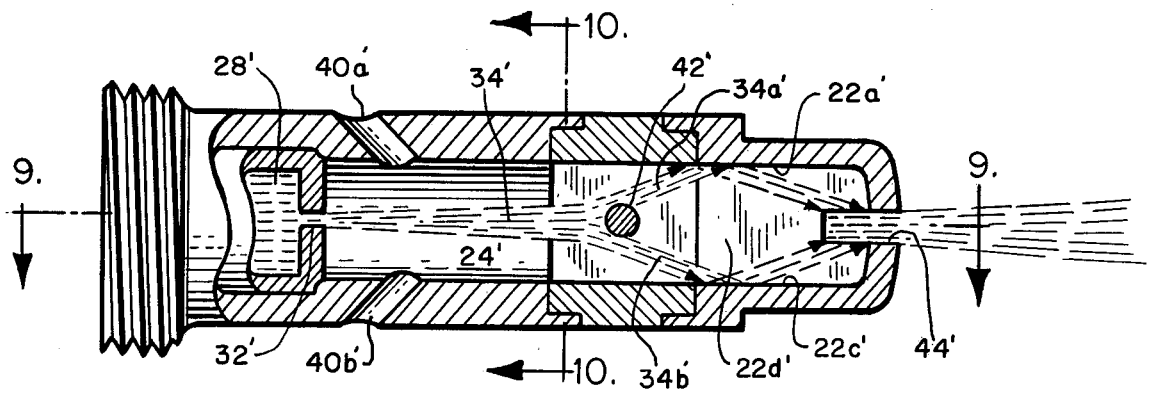
FIG. 8 is a side elevation section view taken along line 8—8 of FIG. 7.
Figure 9:
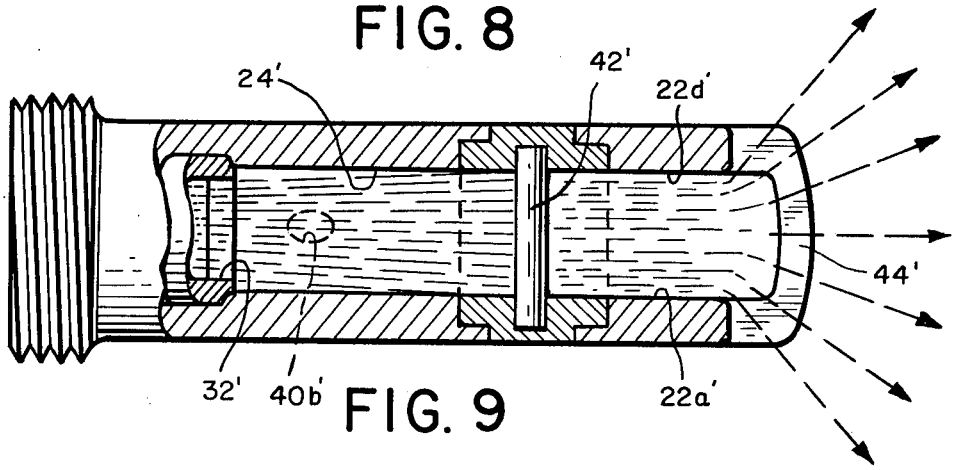
FIG. 9 is a plan sectional view taken along line 9—9 of FIG. 8.

As shown in FIGS. 7–9, the apertures 40a' and 40b' of this embodiment are drilled diagonally into the nozzle body 12' toward the downstream end 16' of the nozzle 10'. Under some conditions this will increase the aspiration of air into the nozzle passage 24'.

Figure 10:
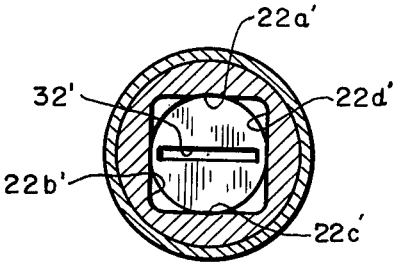
FIG. 10 is an end elevation sectional view taken along line 10—10 of FIG. 8.

As depicted in FIG. 10, the inner walls of this embodiment downstream of the slit orifice 32' approximately define a square with top and bottom walls 22a' and 22c', and lateral walls 22b' and 22d'. The top and bottom walls 22a' and 22c' are substantially parallel to the impingement pin 42' and the discharge slot 44'. This feature takes full advantage of the wide plane-shaped stream 34' of foam producing agent which is generated by the slit orifice 32'. Under some conditions, this type of inner wall configuration will result in a superior mixture of the air and foam producing agent and will more closely complement the configuration of the discharge slot 44'.

The operation of the embodiment of FIGS. 7–10 will now be described. Foam producing agent is introduced under pressure into the upstream end 14' of the nozzle 10'. The slit orifice 32' forms a substantially plane-shaped stream 34' which passes between the diagonal apertures 40a' and 40b', thus aspirating air into the nozzle passage 24'.

The broad stream 34' then impinges upon the impingement pin 42 which disrupts the flow of the stream 34' and splits it into two secondary streams 34a' and 34b'. These streams 34a' and 34b' are directed outwardly toward the top and bottom inner walls 22a' and 22c' of the nozzle body 12' and begin to mix with the air which has been aspirated into the nozzle passage 24'. These walls deflect the secondary streams 34a' and 34b' inwardly toward the discharge slot 44', and continue to mix the air with the foam producing agent. The secondary streams 24a' and 34b' converge in the vicinity of the discharge slott 44', thus completing the aeration process, and are discharged from the nozzle 10' in the form of a wide, flat spray.

Of course, it should be understood that various changes and modifications of the preferred embodiments described herein will be apparent to those skilled in the art. For example, the features found in the embodiment of FIGS. 7–10 can be combined in varying ways with the structure disclosed in FIGS. 1–6. Such changes and modifications apparent to those skilled in the art can be made without departing from the spirit and scope of the present invention and without diminishing its attendant advantages. It is, therefore, intended that such changes and modifications be covered by the following claims.

I claim:

1. A foam generating nozzle comprising:

a nozzle body having upstream and downstream ends and an inner wall defining a passage within said nozzle body;

a nozzle inlet at said upstream end of said nozzle body for introducing a liquid foam producing agent into said passage;

orifice means positioned within said passage downstream of said nozzle inlet, said orifice means having an axis extending in a direction parallel to said nozzle body, said orifice means having a dimension smaller than the diameter of the passage through said nozzle body, said orifice means being adapted to form a stream of foam producing agent in said passage when the foam producing agent is introduced into said nozzle inlet and through said orifice means;

gas inlet means in said nozzle body downstream of said orifice means for introducing a gas into said passage;

pin means disposed transversely across said passage, said pin means being substantially circular in cross-section and being positioned downstream of said gas inlet means for splitting the stream of foam-producing agent into expanding secondary streams which pass to each side of said pin means and are directed outwardly from said axis to effect a thorough mixing of the foam producing agent and the gas introduced through said gas inlet means; and a nozzle outlet at said downstream end of said nozzle, said nozzle outlet comprising a transverse slot disposed parallel to said pin means so that a flat, fan-shaped spray of foam is discharged from said nozzle.

2. The nozzle of claim 1 wherein said inner wall of said body is annular in cross-section downstream of said pin means, said annular inner wall being adapted to deflect the secondary streams of foam producing agent inwardly toward said axis.

3. The nozzle of claim 1 wherein said inner wall includes two substantially planar surfaces downstream of said pin means disposed substantially parallel to said pin means, said planar surfaces being adapted to deflect the secondary streams of foam producing agent inwardly toward said axis.

4. The nozzle of claim 1 wherein said pin means and said nozzle outlet are positioned relative to each other such that the secondary streams of foam producing agent deflect off said nozzle inner wall and converge in the vicinity of said nozzle outlet.

5. The nozzle of claim 1 wherein said orifice means comprises an orifice in a plate, said plate being transversely mounted across said passage, and wherein said plate and orifice are disposed such that the stream of foam producing agent formed by said orifice passes from said orifice in direction parallel to said axis.

6. The nozzle of claim 1 wherein said gas inlet means comprises a plurality of radially spaced apertures in said nozzle body positioned such that the stream of foam producing agent passes substantially between at least two of said apertures.

7. The nozzle of claim 1 wherein said apertures are inclined in a downstream direction to further facilitate aspiration of gas toward said downstream end of said passage.

8. The nozzle of claim 1 wherein said orifice means and said gas inlet means are positioned relative to each other such that the stream passing from said orifice means reduces the pressure in said passage adjacent said gas inlet means to a pressure below atmospheric pressure so that the gas is aspirated through said gas inlet means and into said passage.

9. The nozzle of claim 1 wherein said orifice means are linear and extend transversely across at least a portion of said passage parallel to and in axial alignment with said pin means.

10. A foam generating nozzle comprising:

a nozzle body having upstream and downstream ends and an inner wall defining a passage within said nozzle body;

a nozzle inlet at said upstream end of said body for introducing a liquid foam producing agent into said passage;

a plate member positioned downstream of said nozzle inlet transversely mounted across said passage, said plate member having a central orifice therein with an axis extending in a direction parallel to said nozzle body, said orifice having a diameter smaller than the diameter of the passage through said nozzle body, said orifice being adapted to form a cylindrical stream of foam producing agent in said passage when the foam producing agent is introduced under pressure into said nozzle inlet, the cylindrical stream passing from said orifice in a direction parallel to said axis;

a plurality of radially spaced air inlet apertures in said nozzle body downstream of said orifice for introducing air into said passage, said apertures and said orifice being positioned relative to each other such that the stream passing from said orifice reduces the pressure in said passage adjacent said apertures to a pressure below atmospheric pressure so that air is naturally aspirated through said apertures and into said passages;

pin means in which at least the upstream half of the cross-section of said pin means is annular, said pin means being positioned downstream of said apertures and disposed transversely across said passage for splitting the stream of foam producing agent into expanding secondary streams which pass to each side of said pin means and are directed outwardly from said axis such that the foam producing agent and the air introduced through said air inlet apertures are thoroughly mixed;

a nozzle outlet at said downstream end of said nozzle, said nozzle outlet including a transverse slot disposed parallel to said pin means, said pin means and said slot being positioned relative to each other such that the secondary streams formed by said pin means are deflected inwardly toward said axis by said inner walls and converge in the vicinity of said transverse slot to effect a thorough mixing between the foam producing agent and the air introduced through said air inlet apertures, and thereby discharging a flat, fan-shaped spray from said nozzle.

11. The nozzle of claim 10 wherein the pin means is circular in cross-section.

12. A method of producing foam comprising:

introducing a foam producing agent under pressure into the inlet end of a nozzle having inner walls defining a passage;

passing the foam producing agent through an orifice having an axis, thereby forming a stream having a dimension smaller than the diameter of the passage through said nozzle body;

aspirating air into said passage through air inlet apertures in said nozzle by passing the stream past said air inlet apertures such that the air fills a plenum between the stream and the nozzle passage;

impinging the stream against annularly cross-sectional pin means extending transversely across said passage to split the stream of foam-producing agent into two secondary streams which are directed outwardly with respect to said axis to each side of said pin means;

deflecting the secondary streams inwardly off said inner walls after the secondary streams have been outwardly deflected by said pin means; and discharging the secondary streams from a slot in the outlet end of said nozzle, said slot positioned in the vicinity of the convergence of the secondary streams.

* * * * *